United States Patent [19]

McInnis

[11] 4,196,812

[45] Apr. 8, 1980

[54] STACKABLE RACK

[76] Inventor: James H. McInnis, P.O. Box 288, Compton, Ill. 61318

[21] Appl. No.: 817,473

[22] Filed: Jul. 20, 1977

[51] Int. Cl.[2] ..... A47F 7/00

[52] U.S. Cl. ..... 211/40; 211/194

[58] Field of Search ..... 211/40, 42, 184, 194; 108/111, 114, 153, 158; 312/257, 264, 265; 297/440-443

[56] References Cited

U.S. PATENT DOCUMENTS

| | | | |
|---|---|---|---|
| 293,374 | 2/1884 | Swift | 211/60 R |
| 1,120,941 | 12/1914 | Jones | 211/51 |
| 3,888,353 | 6/1975 | Leifheit | 211/37 |
| 3,977,527 | 8/1976 | Rose et al. | 211/113 X |

FOREIGN PATENT DOCUMENTS

| | | | |
|---|---|---|---|
| 819084 | 8/1959 | United Kingdom | 211/41 |

*Primary Examiner*—Roy D. Frazier
*Assistant Examiner*—Robert W. Gibson, Jr.
*Attorney, Agent, or Firm*—William D. Hall

[57] ABSTRACT

This disclosure covers a rack or stand for supporting or containing one or more disc phonograph records, and/or one or more albums of such records, and/or anything essentially flat in a compact and wieldy arrangement such that two or more of the racks or stands may be stacked, one upon another, to provide a single furniture-type unit.

22 Claims, 16 Drawing Figures

STACKABLE RACK

BACKGROUND OF THE INVENTION

Conventional phonograph records, and record albums, are furnished in a great profusion of sizes and styles. Conventional elements of this type come in sizes such as (nominal disc diameters) 10-inch, 12-inch (and smaller) and an assemblage of such records into an album may encompass from one to six or more records.

Commercial arrangements for handling and storing such records and albums range from a mere cabinet to contain random piles of records and albums, to an assembly of inverted wire-like V's on a base, between which V's the records or albums are received on edge, as it were. Such arrangements do not conduce to efficient or systematic finding of a particular record or album, nor do they permit efficient expansion of the collection when new acquisitions are to be incorporated. Many serious collectors have a considerable number of very old-fashioned shellac pressings, and it would be desirable to make some provision for such antiques.

An object of this invention is to provide such a rack or assemblage which can readily be marketed as a knocked-down group of essentially flat planar elements and essentially cylindrical or rod-like connectors, called herein rods for simplicity.

Another object of the invention is to provide a simple and low-cost rack or assemblage.

A further object of the invention is to provide a rack or assemblage as described in the immediately preceding object which is suitable for phonograph records or albums of such records.

A further object of the invention is to provide a storage rack or assemblage as described in the immediately preceding object which is especially suitable for one or more of any and all objects which are essentially flat, plate-like, wafer-like or planar such as magazines, file folders, photographic plates or even the flat planar elements comprising part of the invention itself.

Regarding the two immediately preceding objects of the invention, it is understood that the dimensions of the rack will vary, depending on what it is intended to store in a compact and wieldy arrangement.

Other objects or advantages of the invention will appear as this invention proceeds.

SUMMARY OF THE INVENTION

The invention comprises flat boards or plates with suitable holes through the board, and indents in an end of the board. The holes receive rods which have notches. The rods can be inserted through the holes in the plate or board and then moved sidewise, in one simple motion, to attach the rods to the plate or board. As a result, a rack may be assembled very quickly from several inexpensive parts. A separate feature of the invention, which constitutes an improvement on the basic concept described above, is that by suitably placing indents in the ends of the plates or boards, the height of the rack may be expanded ad infinitum, assuming, of course, that additional rods and flat boards or plates are available for such purpose. Another separate feature of the invention which can be considered to constitute an improvement on the basic concept described above is that by inserting a flexible plug between the rods and the holes in the plate or board, the attachment made between the rods and the holes absolutely resists being dis-attached, pulled apart or disengaged from any and all directions.

When three or more parallel plates form a rack, it is an improvement feature of the invention to space the holes in the middle plate slightly closer together than the complimentary holes in the outer plates. The rods, which have at least some resilience therefore flex and tend to lock the three plates together.

DETAILED DESCRIPTION OF THE INVENTION

It is necessary, for an understanding of the present invention, that the reader understand the sense in which I later use the term "notch." I use this term to refer to a cutaway portion of the cylindrical or rod-like connectors mentioned in the foregoing "Summary of the Invention." More specifically, I use it to refer to the confining or defining walls of that cutaway portion, so terminology such as "engaging the notch" really means "engaging the walls of the notch."

Figure 1:
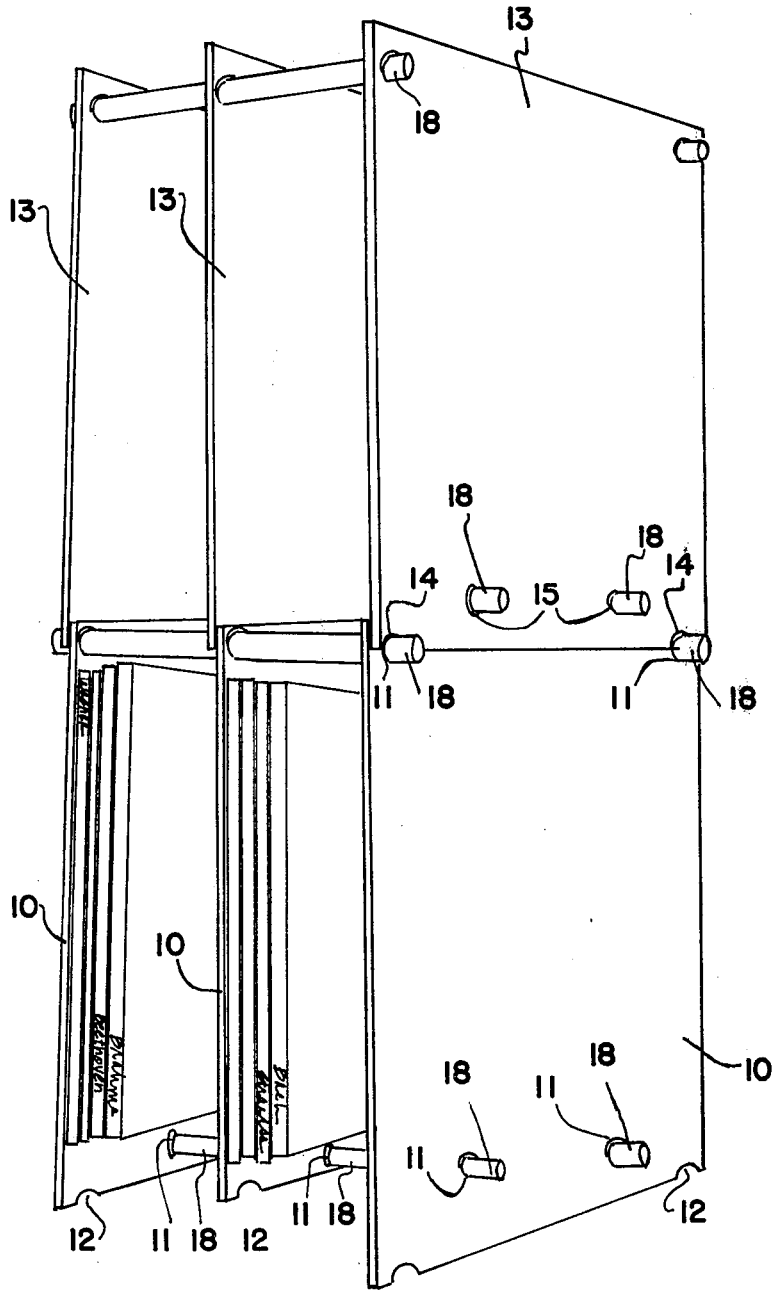
FIG. 1 is a front view of a rack assembled in accordance with the invention.
Figure 2:
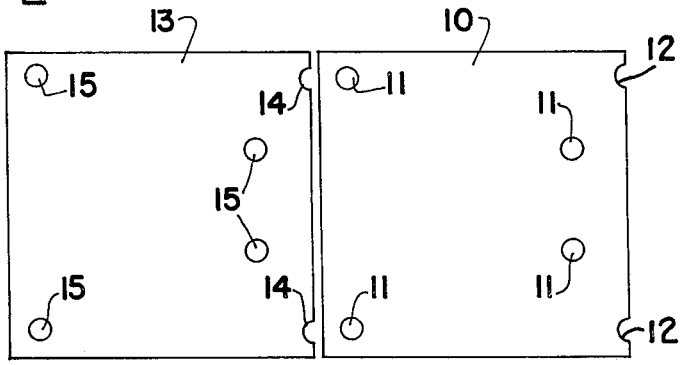
FIG. 2 is a side view of the plates or boards used in the assemblage of FIG. 1.

In FIGS. 1 and 2, plates 10 have four suitable round holes 11, and indents 12. A second set of plates 13 may also be used, and it has indents 14, and holes 15.

Figure 3:
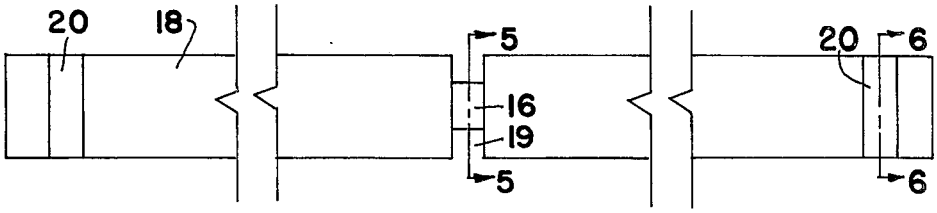
FIG. 3 is a front view of a rod used for interconnecting parallel plates such as those shown in FIG. 2.
Figure 4:
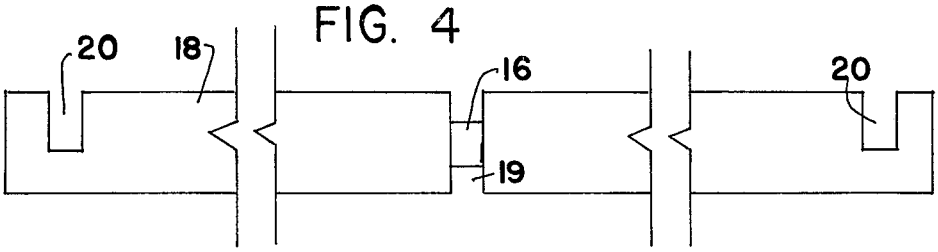
FIG. 4 is a side view of the rod of FIG. 3.
Figure 7:
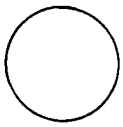
FIG. 7 is an end view of the rod of FIG. 3.
Figure 5:
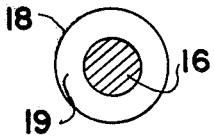
FIG. 5 is a cross-sectional view taken along line 5—5 of FIG. 3.

One form of suitable rod is shown in FIG. 3. It employs a rod 18 having an annular notch 19 near the middle thereof and two notches 20 near the opposite ends of the rod.

A suitable number of rods 18 are supplied with the plates 10 so that a rack can be assembled. Assuming that one wishes to install a single rack, he would use three plates 10 and four rods 18. The outside diameter of rod 18 is very slightly smaller than the diameter of holes 11.

The width of notches 19 and 20 are about equal to the thickness of the board or plate 10. Thus, when it is desired to assemble the rack of FIG. 1, the rod 18 is inserted through hole 11 until notch 20 is at the same position as the board or plate 10. The rod 18 is then moved a slight distance so that notch 20 makes a friction fit against those particular side walls of plate 10, adjacent hole 11, to thus hold the rod 18 and plate 10 together. As a first step, the four rods 18 are placed in the four holes 11 of plate 10 and moved downward to join the four rods to the plate 10. A second plate 10 may then be installed by passing the four free ends of the four rods 18 through the four holes of the second plate 10 until the second plate 10 reaches approximately the same position as the four notches 19 in the four rods 18. The second plate is then moved relative to the four rods so that a friction fit occurs between the four notches 19 and the areas of the plate adjacent the four holes 11 of the plate 10. Finally the free ends of the four rods 18 are inserted into the four holes 11 of the third plate 10, and that third plate is moved until it is in alignment with the right-hand slots 20 (FIG. 3) of the rods 18 whereupon the third plate is then moved relative to the four rods 18 so that the slots 20 make a friction fit with the plate 10 adjacent holes 11. The lower portion (comprising plate 10 and rods 18) of FIG. 1 is thus assembled and is a complete and operative rack for storing flat objects.

One suitable material for plate 10 is so-called presdwood sold under the trade-name Marlite. A thickness of one-quarter inch is suitable. The rods 18 may be made of wood, for example, maple, or of any other suitable material. The snug fit between the rod 18 and the plates 10 is achieved, in one embodiment of the invention, by having the notches 19 and 20 about 0.006 inches wider than the thickness of the plate 10.

Figure 8:
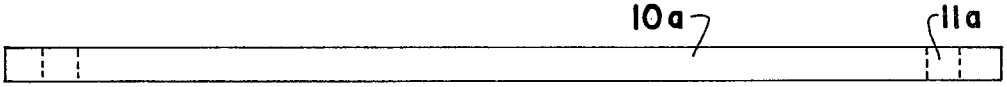
FIG. 8 is an end view of a suitable plate or board which may be used in event the "vertical expansion" feature of the invention is not desired.

If it is desired to expand vertically the size of the rack a second section embodying plates 13 and rods similar to 18 may be added, as will now be explained with reference to FIGS. 1, 2 and 8. The rods 18 for the second section are the same as for the first section except the notches 19 and 20 may be slightly displaced so that the two sections may fit together without plates 10 and 13 colliding head-on with each other.

To assemble the second section, the same general procedure is followed as for the first section, that is, in the completed rack, the three plates 13 are parallel to each other with four rods similar to 18 passing through the four holes 15 respectively. The three plates 13 are then moved with respect to the rods 18 so that the plates 13 engage the notches 19 and 20 in the rods. The second section may, therefore, be placed above the first section. The indents 14 in plate 13 make a saddle-like friction fit with the rods 18 that interact with holes 11 and this tends to hold the two sections together.

In a modified form of the invention, a plug is employed to fill the space between the rod and the holes 11. FIGS. 9 to 12 show this form of the invention. In those Figures, a plug 20', 21, 22 fills the space resulting from the notch 20 in rod 18. The space of the plug 21 is such to fill the lateral space between the wall of the notch 20 of rod 18 and the wall defining hole 11. Extension 20' on the plug 21 overlaps a limited portion of the one surface of plate 10 and extension 22 overlaps a limited, although smaller, portion of the opposite surface of plate 10. The smaller extension 22 will be distorted as the plug 21 is being inserted into the lateral space between rod 18 and the wall defining hole 11. When it is properly seated, the smaller extension 22 will spring back to its original shape to overlap a portion of the surface of plate 10 because the plug is composed of resilient material such as rubber, plastic or the like. One suitable material for the plugs is K-prene, which is the trade-name of a urethane manufactured by Di-Acro Co.

Figure 6:
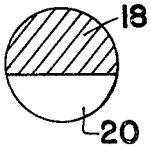
FIG. 6 is a cross-sectional view taken along line 6—6 of FIG. 3.
Figure 15:
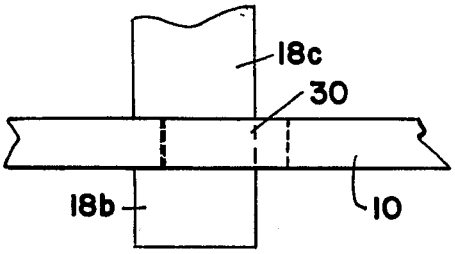
FIG. 15 illustrates a suitable plate such as the one shown in FIG. 2 which is held by a rod of the form shown in FIGS. 13 and 14.
Figure 11:
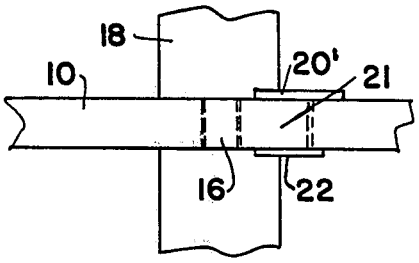
FIG. 11 illustrates a plate held to a rod by the plug of FIGS. 9 and 10.
Figure 14:
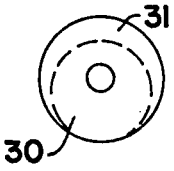
FIG. 14 is an end view of the notch and rod of FIG. 13.
Figure 13:
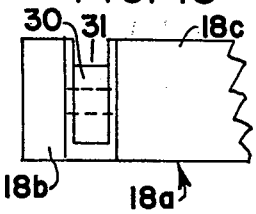
FIG. 13 is the preferred form of the notch in the rod that may be used with the invention.
Figure 12:
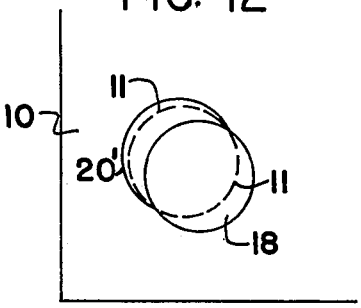
FIG. 12 is a side view of a further modified form of the invention.
Figure 9:
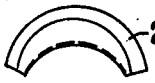
FIG. 9 is a view of a plug that may be used to attach the rod to the plate, in a modified form of the invention.
Figure 10:
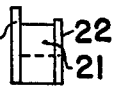
FIG. 10 is a side view of the plug of FIG. 9.

The preferred form of notched rod is shown in FIGS. 13, 14, and 15. There, the rod **18*a*, instead of having a simple notch with a flat surface (see FIG. 6) has a circular element 30 of smaller diameter than rod 18*a*, and off-center, connecting the two portions 18*b* and 18*c* of rod 18*a*. The notch 31, therefore, is defined by the right end wall of portion 18*b*, the periphery of circular element 30, and the left-end wall of portion 18*c*. This form of rod 18*a* and notch 31 may replace all of the rods 18 and notches 20 of FIGS. 1 and 3**.

Therefore, the rack of this invention may consist of a kit of parts which may be assembled to make as many sections of tiers as desired. If just one section is desired one simply employs three plates 10 and four rods 18. If two or more sections are desired, one or more above another, more plates and rods are needed.

For best results, however, half of the rods 18 in the kit should have their notches 20 slightly closer together than for the others. The rods 18 whose notches 20 are closer together are used at the upper ends of the several sections so that the outer plates 13 or 10, as the case may be, taper apart as they pass downward from their upper to their lower rods 18. This facilitates stacking one section on another. Similarly the notch 19 in either the upper or the lower rods of every section may be slightly off-center to avoid the middle plates 13 and 10 of the two sections from colliding.

While the two plates 10 and 13 (FIGS. 1 and 2) bear separate reference numbers they in fact are identical in size, shape and positions of their holes 11 and 15 and their indents 12 and 14.

The indents 12 or 14 as the case may be facilitate stacking of one section on another. The indents 14, for example, of the top section in FIG. 1, make a saddle-like friction fit with the upper rods 18 of the lower section and thus tend to hold the two sections together.

The rods 18 act as supports for the contents of the rack.

Instead of being round, the holes 11 and/or 15 may be any other suitable shape such as square, rectangular, etc.

If the add-on feature shown in FIG. 1 is not required, a rectangular plate **10*a* (FIG. 8) may have four holes 11*a*, one adjacent each corner. The holes 11*a* receive the notches 20 in the rods 18**, the same as described previously.

Figure 16:
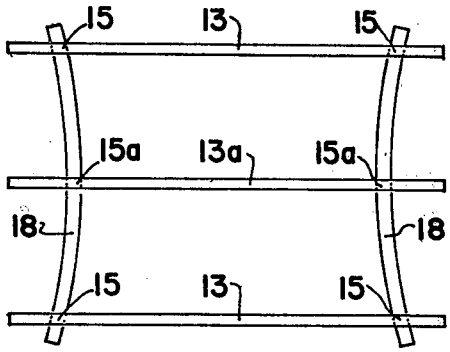
FIG. 16 is a top view of a portion of an improvement and illustrates an improvement that may be employed with any of the various rods, notches and plates described in this application.

A further important improvement, comprising the invention, resides in making the several rods 18 at least slightly resilient and having the middle one of the three plates 10, as well as the middle one of the three plates 13, of FIG. 1, slightly modified from the other two plates 10 and the other two plates 13. This modification consists in locating the two uppermost holes 15 of the middle plate 13 slightly closer together than the corresponding holes 15 of the two outer plates 13. This modification is shown in FIG. 16 (which is a top view showing only two rods 18) where the holes **15*a* in the middle plate 13*a* are slightly out of line with their complementary holes 15 in the two outer plates 13. Since the two holes 15*a* in plate 13 are slightly closer together than the holes 15 in plates 13, the rods 18 are slightly flexed (this flexing being shown somewhat exaggerated in FIG. 16). This tends to lock the three plates 13 and 13*a* together in a rigid formation. I have explained how one set of holes 15, 15***a* (FIG. 16) at the very uppermost end of an assembly (such as that of FIG. 1) may be locked together by a special closer spacing of holes 15*a* versus holes 15. What has been explained for the uppermost holes 15 and 15*a*, and rods 18, of FIG. 16, is equally applicable to the corresponding holes and rods at each level. For example, in FIG. 1 there are four levels or sets of holes 15 and 11; each plate 10 and 13 having upper and lower sets of holes. The improved locking feature in which the holes in the middle plate are slightly closer together is applicable to each of the four sets (levels) and if employed on all four sets (levels) at once forms a very rigid overall structure.

While I show, in FIG. 1, a structure that is three plates wide, it is understood that the structure may be made as wide as desired. In case the structure is extended by adding two additional plates 10 and two additional plates 13, for example, the outermost plates 10 and 13 would have their holes 15 spaced apart the same as holes 15 of FIG. 16 and the remaining plates (which would be located between the right hand plates of FIG. 1 and said outermost plates) would have their holes 15*a* spaced slightly closer together than the complementary holes 15 of the other plates as explained in conjunction with FIG. 16.

In connection with the foregoing description, I have explained a number of different features such as (a) different notches (see FIGS. 3 to 6 and 9 to 12), (b) a plug 21, (c) a tapering feature wherein the lower rods are longer than the upper ones to permit stacking (see FIG. 1), and (d) a locking feature wherein holes 15*a* in a middle plate are slightly closer together than complementary holes in outer plates (see FIG. 16). It is understood that any of these features may be used in combination with any one or more of the others.

I claim:

1. A rack comprising:

a plurality of spaced plates, each said plate having a plurality of holes therein as well as first and second faces comprising opposite sides of the plate, each of said holes having an inner wall, elongated connectors for connecting said plates together, each said connector passing through a hole in each plate, each connector having an outer wall, each connector defining, in its outer wall, one notch for each of said plates; each notch having first and second spaced walls respectively engaging the first and second faces of its complementary plate adjacent to the hole through which the connector passes to form a joint, whereby, for each joint, there is a space between the outer wall of the connector and the inner wall of the hole through which the connector passes, and means for securing the connector to the plate at, at least, some of the joints comprising a flexible plug in the space between the outer wall of the connector and the inner wall of the hole.

2. A composite rack as defined in claim 1, in which the rack defined in claim 1 constitutes a first rack, comprising a second rack additional to the first rack, said second rack having the same construction as the first rack and also having notches in an end of each plate, said last-named notches being adapted to snugly grip the connectors of the first rack to tend to hold the first and second racks together.

3. A rack as defined in claim 1 in which at least one of said connectors is a rod and at least one of the notches is annular.

4. A rack as defined in claim 1 in which at least one of said connectors has a cross-section which is a circle and a wall of the notch conforms to a cord of said circle.

5. A rack as defined in claim 1 in which all of said connectors are rods, each such rod having two notches adjacent opposing ends thereof, each said notch being defined, in part, by a surface which is a portion of a circle whose centerline is off-center from the centerline of the rod.

6. A rack as defined in claim 1 in which said notch is defined, in part, by an indentation in the wall of the connector, the surface of the connector where said indentation terminates comprising a convex surface, said flexible plug having a shape conforming to the space between said convex surface and the inner wall of the hole through which the connector passes and also having two extensions at its opposite ends which extensions interface with opposite faces respectively of the plate through which the plug passes, one of said extensions being small enough to enable the plug to be inserted between the connector and the wall defining the hole.

7. A rack as defined in claim 1 in which said plates are joined by at least two spaced connectors adjacent the lower end of the plates and at least two spaced connectors adjacent the uppers ends of the plates, and a second rack as defined in claim 1 in which the lower ends of the plates have notches for engaging the spaced connectors adjacent the upper ends of the plates of the first-named rack to thus permit said second rack to be stacked above the first-named rack.

8. A rack system as defined in claim 7 in which the notches in the connectors make a friction fit with the plates which they engage.

9. A rack comprising:

a plurality of spaced plates, each of said plates having a plurality of holes therein, elongated connectors for connecting said plates together, each said connector passing through a hole in each plate, each said connector defining one notch, in the side wall thereof, for each plate; each notch engaging portions of the opposite surfaces of its complementary plate adjacent to the hole through which the connector passes, said plurality of spaced plates comprising at least three parallel plates; one of which is a middle plate and the other two of which are outer plates, the holes in said outer plates being spaced apart the same distance, the holes in the middle plate being spaced apart a different distance than the complementary holes in the outer plates, said elongated connectors being at least slightly flexible so that the different hole spacing in the middle plate flexes the elongated connectors and causes them to hold the plates together.

10. A rack as defined in claim 1 in which each of said plates is substantially rectangular with one of said holes near each corner of the rectangle.

11. A rack as defined in claim 7 in which each rack has at least three plates and each plate of each rack is substantially rectangular, each plate having one of said holes near each corner of the rectangle.

12. A stackable rack comprising:

first and second upright parallel spaced plates, each plate having two faces, each plate having a plurality of at least three holes therethrough perpendicular to the faces of the plate, first and second of said holes of each plate being spaced apart horizontally in the upper half of the plate and another hole being in the lower half of the plate, the plurality of holes in the two plates being in the same relative positions respectively, whereby each hole in one plate has a complementary hole in the other plate, and a plurality of connectors connecting the two plates together, each connector passing through a hole in one plate as well as through its complementary hole in the other plate, and each connector having two notches in its side wall which notches are spaced apart substantially the same distance by which the plates are spaced apart, there being one notch in each connector for each plate, each notch having first and second faces respectively frictionally engaging the first and second faces of its complementary plate to hold the plate to the connector, each said plate having notches at its lower end, the notches in each plate being spaced apart horizontally a distance equal to the spacing between said first and second holes; so that said plates and connectors form a first rack which may be stacked on top of a second rack, which is similar to the first one, by placing the notches in the plates of the first rack onto the two connectors that pass through the holes in the upper half of the second rack.

13. A stackable rack as recited in claim 12, wherein there are four holes in each plate, two of said holes being horizontally spaced apart near the upper end of the plate and the other two holes being horizontally spaced apart near the lower end of the plate, the horizontal spacing in each case being sufficient to provide rigidity to the stackable rack.

14. A stackable rack as recited in claim 12, further comprising plugs in the gaps between said connectors and said plates.

15. A stackable rack as recited in claim 14, wherein each plug has an extension that interfaces with at least one face of the plate with which the plug is associated.

16. A stackable rack as recited in claim 14 wherein each plug has two extensions that respectively interface the two faces of the plate with which the plug is associated.

17. A stackable rack as defined in claim 12 wherein there is a third plate parallel to the first and second plates, said third plates having at least three holes in substantially the same relative positions as holes in the first and second plates, whereby the third plate has a hole complementary to each hole in the first plate, said third plate having two faces, said connectors having notches that have first and second faces that respectively engage the two side walls of the third plate to thus secure the third plate to the connectors.

18. A stackable rack as defined in claim 17 in which the connectors are resilient and the holes in the third plate are slightly out of alignment with those in the first and second plates so that the connectors have a slight flexing that causes the notched portions of the connectors to more firmly engage the plates.

19. A stackable rack as defined in claim 12 in which each plate has an inside face and an outside face, the inside faces facing each other, said connectors being longer than the spacing between the outside faces of the first and second plates to form extensions upon which another stackable rack may be placed.

20. A rack comprising:

first and second upright parallel spaced plates, each plate having two faces, each plate having a plurality of at least three holes therethrough perpendicular to the faces of the plate, first and second of said holes of each plate being spaced apart horizontally in the upper half of the plate and another hole being in the lower half of the plate, the plurality of holes in the two plates being in the same relative positions, respectively, whereby each hole in one plate has a complementary hole in the other plate, a plurality of connectors connecting the two plates together, each connector passing through a hole in one plate as well as through its complementary hole in the other plate, and each connector having two notches in its side wall which notches are spaced apart substantially the same distance by which the plates are spaced apart, there being one notch in each connector for each plate, said notches having first and second faces spaced apart a distance greater than the thickness of the plate, the faces of the notches respectively facing the faces of the plate to thus provide, in each hole, a space between the connector and the plate, and a plurality of plugs, at least some of said spaces having said plugs therein, to provide added rigidity to the rack.

21. A rack as defined by claim 20 in which each plate has two notches in the lower end thereof, the notches in the plates being in the same relative positions and the notches in each plate being spaced apart by a distance equal to the distance between two connectors that pass through the upper half of the plate so that the rack may be stacked on top of a similar rack.

22. A rack as defined in claim 20 in which each plate has two holes spaced apart horizontally in the upper half of the plate and two holes spaced apart horizontally in the lower half of the plate, the holes in each plate being in the same relative positions as the holes in the other plate, said plurality of connectors comprising four connectors that respectively pass through the four holes in each plate and thus hold the plates and connectors together, the holes being spaced apart a sufficient distance to give the rack rigidity.

* * * * *